US005282742A

United States Patent [19]

Ellringmann

[11] Patent Number: 5,282,742

[45] Date of Patent: Feb. 1, 1994

[54] DOUBLE WALKING BEAM FURNACE FOR THE HEAT TREATMENT OF INDIVIDUAL PARTS

[75] Inventor: Kurt Ellringmann, Bad Iburg, Fed. Rep. of Germany

[73] Assignee: Maerz Ofenbau GmbH, Dusseldorf, Fed. Rep. of Germany

[21] Appl. No.: 897,399

[22] Filed: Jun. 12, 1992

[30] Foreign Application Priority Data

Jun. 14, 1991 [DE] Fed. Rep. of Germany ..... 4119708

[51] Int. Cl.[5] ..... F27B 9/24

[52] U.S. Cl. ..... 432/122; 414/525.9; 432/242

[58] Field of Search ..... 432/122, 123, 242; 414/156, 173, 198, 525.9; 277/135

[56] References Cited

U.S. PATENT DOCUMENTS

| | | | |
|---|---|---|---|
| 4,330,262 | 5/1982 | Kranzl et al. | 432/122 X |
| 4,556,385 | 12/1985 | Denis | 432/122 |
| 4,741,695 | 5/1988 | Ushijima | 432/122 X |
| 4,820,150 | 4/1989 | Ushijima | 432/122 X |

*Primary Examiner*—William E. Tapolcai
*Attorney, Agent, or Firm*—Staas & Halsey

[57] ABSTRACT

A double walking beam furnace for the heat treatment of individual articles which includes a transport apparatus for conveying the part to be treated through the furnace, the transport apparatus including two groups of longitudinal beams which alternately transport the parts in a stepwise manner. The longitudinal beams are alternately arranged in spaced relationship to one another, and a sub-structure is provided beneath each beam to carry the beam and move together therewith. The sub-structure effect both a perpendicular movement and a horizontal movement, in the longitudinal direction of the furnace, of the longitudinal beams. A fixed water trough is provided between each two adjacent sub-structures, which extends approximately over the entire length of the furnace or hearth and is not movable together with the sub-structures, which extends approximately over the entire length of the furnace or hearth and is not movable together with the sub-structure. Dip skirts arranged on the adjacent sub-structures and movable therewith are immersed in the water troughs in order to seal the furnace at its bottom in a gas-tight manner. The water troughs are made up of separate longitudinal channels which are substantially flangeless and welded or bonded to one another at their abutting end faces.

6 Claims, 1 Drawing Sheet

DOUBLE WALKING BEAM FURNACE FOR THE HEAT TREATMENT OF INDIVIDUAL PARTS

BACKGROUND

1. Field of the Invention

The invention relates to a double walking beam furnace for the heat treatment of individual parts, for example sheet metal, comprising a transport apparatus for conveying the parts to be treated through the furnace, the transport apparatus having two groups of longitudinal beams which alternatively transport the parts in a stepwise manner. These longitudinal beams are alternatively arranged adjacent one another in spaced relationship, a sub-structure being provided beneath each longitudinal beam and supporting and moving together with this, the sub-structure effecting the vertical movement and the horizontal movement in the longitudinal direction of the furnace of the longitudinal beam and of the bottom part of the furnace which is usually arranged beneath and moved together with the beam. Between two respectively adjacent sub-structures, a water trough is arranged which extends approximately over the entire furnace or hearth length and is immovable with respect to the base assembly. Dip skirts arranged on the neighbouring sub-structures and movable together with these are immersed in the respective water trough in order to seal the furnace at its bottom in a gas-tight manner. The water troughs are made up of separate longitudinal channels for constructive reasons.

2. Description of the Related Art

In known double walking beam furnaces of this kind, the longitudinal channels of the water troughs are provided at their abutting end faces with outwardly projecting flanges which are bolted together with sealing strips arranged therebetween in order to achieve a secure and liquid-tight joint of the abutting longitudinal channels.

In view of the fact that the individual parts to be treated in the furnace must be supported on at least two longitudinal beams per beam group and sheet-like parts should, for reasons of support, not or only slightly project laterally over the displacable beams supporting the parts, a centre-to-centre spacing between the adjacent displacable beams of both beam groups which is as small as possible is desirable. In the double walking beam furnaces known up to now, it was not possible for reasons of the structurally limited minimum cross sectional dimensions of the water troughs and dip skirts as well as the supporting or sub-structures of the longitudinal beams located at approximately the same height to realize a centre-to-centre spacing of less than 400 mm so that the transport of thin sheeting resulted in significant problems on account of the existing danger of too great a lateral projection over the edge.

SUMMARY OF THE INVENTION

It is an object of the present invention to reduce the centre-to-centre spacing of the longitudinal beams in the double walking beam furnaces of the type initially mentioned, i.e. to reduce this to a spacing of less than 400 mm. This is achieved in accordance with the invention in that the longitudinal channels of the water troughs are substantially flangeless at their abutting end faces and are welded or bonded to one another. On account of the omission of the flanges, the maximum width dimensions of the water troughs are considerably reduced, on account of which the mutual minimum spacing of the adjacent supporting or sub-structures of the longitudinal beams located at the sides of the water troughs can also be reduced. This makes it possible to reduce a centre-to-centre spacing of two adjacent longitudinal beams to less than 400 mm. The welded or bonded joint can be made sufficiently stable and liquid-tight without problems so that the danger of leaks in the water trough does not arise.

In the inventive flangeless arrangement of the longitudinal channels, these are usefully butt-welded or butt-bonded at their end faces, i.e. at their abutting surfaces. Should it be necessary for reasons of strength, the longitudinal channels can additionally be joined with one another by means of joining members or brackets positioned at at least one longitudinal wall, for example at the underside of the bottom wall and secured there, for example, by means of welding, bonding or the like.

In view of the inventive inseparable joint of the longitudinal channels, the water troughs cannot be disassembled and removed from the hearth and placed back into their location of use for repair or renewal purposes. It is expedient to arrange the furnace at its inlet or outlet end in front of the end faces of the water troughs in such a manner that the water troughs can be removed from the hearth in the longitudinal direction with their whole length in one piece. This can be realized in that the furnace is free of hindrances at this end for such a removal. This is also sensible for the purposes of simple assembly.

BRIEF DESCRIPTION OF THE DRAWINGS

In the drawings a particularly advantageous exemplified embodiment of the inventive double walking beam furnace is shown which is described in detail in the following, wherein.

DESCRIPTION OF THE PREFERRED EMBODIMENTS

Figure 1:
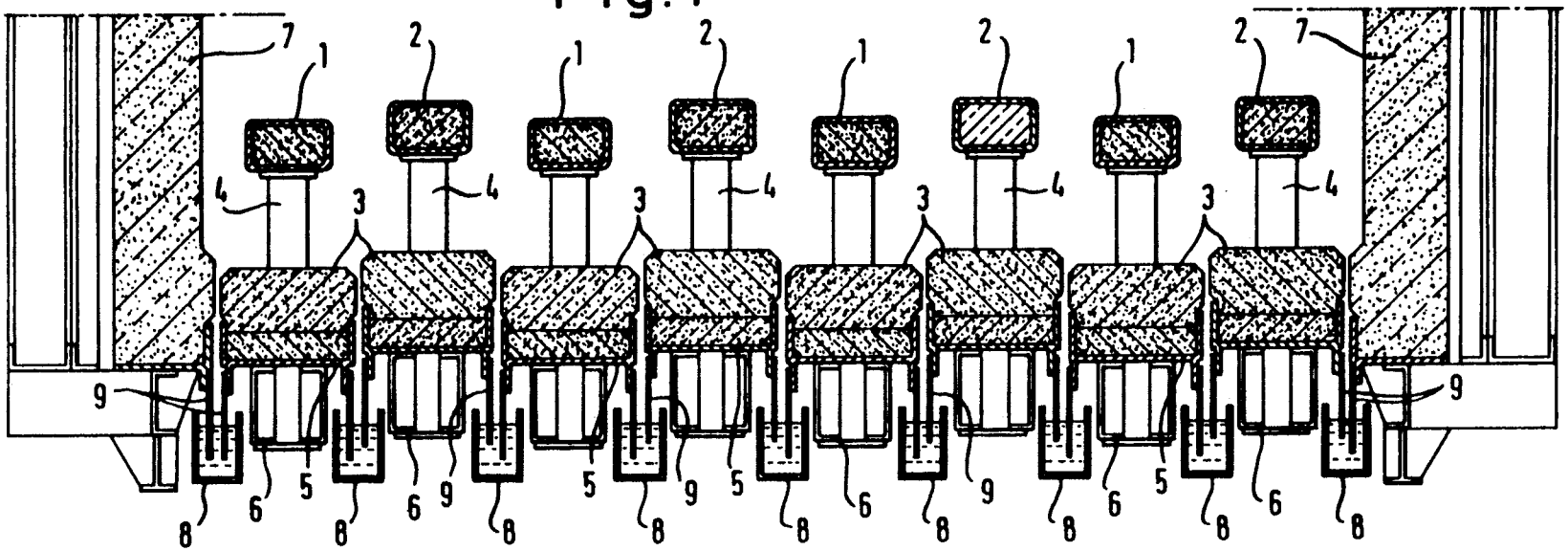
FIG. 1 is a cross-section through a lower furnace part of a double walking beam furnace according to the present invention.
Figure 2:
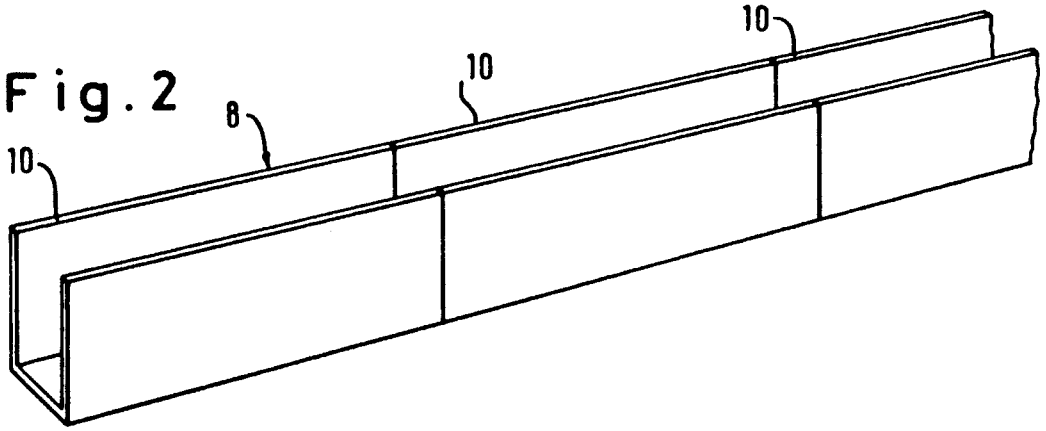
FIG. 2 is an isometric view of a portion of a water trough provided in a double walking, beam furnace according to the present invention.

The double walking beam furnace depicted in the drawing has two groups of longitudinal beams 1, 2 lying adjacent one another as seen in the cross section of the furnace, the beams 1, 2 of both groups being spaced alternatively adjacent one another. A bottom part 3 forming the hearth base of the furnace is located beneath each of these longitudinal beams 1, 2, the bottom part being connected via stays 4 with the longitudinal beam 1 or 2 located thereabove. These bottom parts consist of heatresistent blocks which are held in a fixture 5.

Together with their bottom parts 3 the longitudinal beams 1, 2 of each beam group carry out a stepped transport movement in the vertical direction and a horizontal direction aligned in the longitudinal direction of the furnace, for the purposes of which a correspondingly movable supporting or sub-structure 6 is provided at the underside of each bottom part.

In order to achieve a gas-tight sealing of the hearth at its underside, water troughs 8 are provided beneath the gaps between the bottom parts 3 and between the outer bottom parts and the adjacent fixed side walls 7 of the furnace and laterally of the supporting and sub-structure 6, wherein the dip skirts 9 effecting the gas seal, which are arranged on both lateral lower edges of the bottom parts 3 and the side of the fixed side walls 7 of the furnace facing the outermost bottom parts, are immersed in water troughs filled with water. The water troughs 8 and the dip skirts 9 extend substantially over the entire furnace or hearth length, and the water troughs are fixed within the hearth and the dip skirts are arranged on the bottom parts 3 and move together with these bottom parts.

On account of the relatively long length of the water troughs, these respectively consist of a number of longitudinal channels 10 arranged successively in the longitudinal direction of the trough and having a constant wall thickness over their entire length. These longitudinal channels are welded or bonded in a liquid-tight manner at their end faces along their abutting surfaces.

The longitudinal channels of each water trough are inseparably joined to one another on account of the welded or bonded joint. Therefore these cannot as in the case of the releasably bolted longitudinal channels of the previously known double walking beam furnaces of the type initially mentioned, be separated from one another and individually removed from the furnace or replaced back into their location of application for the purposes of repair or replacement of the troughs. As the water troughs in the presently described double walking beam furnace can only be removed in their entirety, namely their entire length for the purposes of repair or replacement of the water troughs in the easiest manner possible without an extensive disassembly of furnace parts being necessary, the furnace should be designed at one of its ends, i.e. either at its inlet or its outlet end in the region of the end faces of the water troughs, in such a manner that it is free in this region from hindrances for the removal of the water troughs from the hearth in a longitudinal direction.

In order to be able to demount and remount the water troughs in their entire length without previously removing the dip skirts, the end walls of the troughs should be removable, for example, by means of bolts which are applied together with seals.

What is claimed is:

1. A double walking beam furnace for the heat treatment of individual articles, said furnace comprising:

a transport apparatus for conveying the articles to be heated through the furnace, said transport apparatus having two groups of movable longitudinal beams which alternately transport the articles in a step-wise manner, said beams being alternately arranged in spaced relationship to one another;

a substructure arranged beneath each longitudinal beam for supporting each beam and being movable together therewith;

a fixed water trough provided between each two adjacent substructures, each water trough extending substantially over the entire length of the furnace, each water trough being constructed of a plurality of separate longitudinal channels, said longitudinal channels being substantially flangeless and welded to one another at their abutting end faces; and dip skirts mounted on each substructure and movable together with the substructure, said dip skirts being immersed in the water troughs.

2. A double walking beam furnace according to claim 7, wherein the longitudinal channels are welded at the abutting surfaces of their end faces.

3. A double walking beam furnace according to claim 7, wherein the longitudinal channels are additionally connected by means of joining members placed on at least one longitudinal wall and secured thereto.

4. A double walking beam furnace according to claim 3, wherein the joining members are secured at the underside of the base wall of the longitudinal channels.

5. A double walking beam furnace according to claim 7, wherein the furnace is arranged free of hindrances at at least one end in front of the end faces of the water troughs for removal of the water troughs in their entire length from the furnace in a longitudinal direction.

6. A double walking beam furnace according to claim 7, wherein the end walls of the water troughs are removably attached.

* * * * *

UNITED STATES PATENT AND TRADEMARK OFFICE

CERTIFICATE OF CORRECTION

PATENT NO. : 5,282,742

DATED : February 1, 1994

INVENTOR(S) : Kurt ELLRINGMANN

It is certified that error appears in the above-identified patent and that said Letters Patent is hereby corrected as shown below:

Title Page, under "[30] Foreign Application Priority Data", change "4119708" to --4119708.9--.

Column 1, line 5, change "BACKGROUND" to --Background of the Invention--.

Column 2, line 21, after "It" insert --therefore--;

line 41, after "walking", delete ",".

Signed and Sealed this

Thirtieth Day of August, 1994

*Attest:*

*Attesting Officer*

BRUCE LEHMAN

*Commissioner of Patents and Trademarks*